US006742568B2

(12) United States Patent
Meyer

(10) Patent No.: US 6,742,568 B2
(45) Date of Patent: Jun. 1, 2004

(54) CASTING APPARATUS INCLUDING A GAS DRIVEN MOLTEN METAL INJECTOR AND METHOD

(75) Inventor: Thomas N. Meyer, Murrysville, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/867,265

(22) Filed: May 29, 2001

(65) Prior Publication Data

US 2002/0179276 A1 Dec. 5, 2002

(51) Int. Cl.[7] ..... B22D 27/13
(52) U.S. Cl. ..... 164/119; 164/113; 164/133
(58) Field of Search ..... 164/119, 113, 164/133, 316, 337

(56) References Cited

U.S. PATENT DOCUMENTS

| | | | | |
|---|---|---|---|---|
| 3,471,057 A | | 10/1969 | Solheim | 222/61 |
| 3,876,191 A | | 4/1975 | Lauersdorf | 266/38 |
| 3,907,962 A | * | 9/1975 | Ogiso | 264/332 |
| 4,216,886 A | * | 8/1980 | Puschalovsky et al. | 164/155.1 |
| 5,657,812 A | * | 8/1997 | Walter et al. | 164/113 |
| 5,846,445 A | | 12/1998 | Umino | 222/590 |
| 5,913,358 A | | 6/1999 | Chadwick | 164/457 |
| 6,358,468 B1 | * | 3/2002 | VanderJagt | 266/239 |

FOREIGN PATENT DOCUMENTS

SU 250391 1/1970

* cited by examiner

*Primary Examiner*—M. Alexandra Elve
*Assistant Examiner*—I.-H. Lin
(74) *Attorney, Agent, or Firm*—Christian E. Schuster; Gary P. Topolosky

(57) ABSTRACT

The casting apparatus (50) includes a holding vessel (10) for containing a supply of molten metal (12) and a casting mold (52) located above the holding vessel (10) and having a casting cavity (54). A molten metal injector (14) extends into the holding vessel (10) and is at least partially immersed in the molten metal (12) in the holding vessel (10). The molten metal injector (14) is in fluid communication with the casting cavity (54). The molten metal injector (14) has an injector body (16) defining an inlet opening (24) for receiving molten metal into the injector body (16). A gas pressurization source (38) is in fluid communication with the injector body (16) for cyclically pressurizing the injector body (16) and inducing molten metal to flow from the injector body (16) to the casting cavity (54). An inlet valve (42) is located in the inlet opening (24) in the injector body (16) for filling molten metal into the injector body (16). The inlet valve (42) is configured to prevent outflow of molten metal from the injector body (16) during pressurization and permit inflow of molten metal into the injector body (16) after pressurization. The inlet valve (42) has an inlet valve actuator (44) located above the surface of the supply of molten metal (12) and is operatively connected to the inlet valve (42) for operating the inlet valve (42) between open and closed positions.

10 Claims, 3 Drawing Sheets

CASTING APPARATUS INCLUDING A GAS DRIVEN MOLTEN METAL INJECTOR AND METHOD

STATEMENT REGARDING FEDERALLY FUNDED RESEARCH

The subject matter of this application was made with United States government support under Contract No. 86X-SU545C awarded by the Department of Energy. The United States government has certain fights to this invention.

BACKGROUND OF THE INVENTION

1. Field of the Invention

The present invention relates to a molten metal casting apparatus and, more particularly, a casting apparatus including a gas driven molten metal injector.

2. Description of the Prior Art

Numerous furnace-ladling devices are known in the art for delivering molten metal from a molten metal container or vessel to a desired point of use, such as a die casting machine. Such devices often include a crucible body that includes a molten metal inlet tube and a molten metal delivery tube for delivering molten metal to a point above the crucible. The molten metal inlet and delivery tubes generally define vertically extending passages through which molten metal from the container or vessel is able to pass through the crucible. The molten metal inlet tube extends upward into the crucible and defines an opening above the operating level of molten metal contained in the crucible. A gas inlet tube provides a third passage into the crucible and through which the crucible may be pressurized to force the molten metal into the delivery tube.

U.S. Pat. No. 3,471,057 to Solheim and U.S. Pat. No. 3,876,191 to Lauersdorf are examples of such furnace-ladling devices known in the art. The crucibles for these devices may be partially or completely submerged in the molten metal in the container or vessel. A known disadvantage with such devices is that the molten metal inlet tube extending upward into the crucible, in operation, allows molten metal to spill over or "free fall" over the top of the tube to refill the crucible. Such a spilling effect often causes metal oxides to form within the crucible and reduces the overall quality of the cast product ultimately made from the molten metal contained in the crucible. The pressure applied to the metal injected is limited by the height of the molten metal inlet tube used to refill the crucible.

U.S. Pat. No. 4,216,886 to Puschalovsky et al. (hereinafter "the Puschalovsky patent") improves upon the arrangement disclosed by the Solheim and Lauersdorf patents by providing a submergible crucible having an inlet opening in the top wall of the crucible and a closing device for selectively closing the inlet opening. However, because the inlet opening is located in the top wall of the crucible, the crucible molten metal enters through the inlet opening during refilling operations and "free falls" into the interior of the crucible. Accordingly, the same molten metal quality issues that exist with the arrangements disclosed by the Solheim and Lauersdorf patents are also present in the arrangement disclosed by the Puschalovsky patent.

U.S. Pat. No. 5,846,445 to Umino discloses an apparatus for transferring molten metal that includes a molten metal chamber positioned within a metal furnace. The molten metal chamber is connected to a bottom wall of the furnace. A fluid feed pipe communicates with the chamber through a sidewall of the chamber. The fluid feed pipe operates as both a molten metal inlet conduit and a molten metal discharge conduit for the chamber. A gas inlet/outlet pipe communicates with the chamber through a top wall of the chamber. The arrangement disclosed by the Umino patent is substantially similar to the arrangements disclosed by the Solheim and Lauersdorf patents, but includes a single molten metal inlet and discharge conduit and the chamber is physically attached to the bottom of the furnace. The arrangement disclosed by the Umino patent overcomes the molten metal "free fall" problems present in the arrangements disclosed by the Solheim and Lauersdorf patents, but due to the position of the chamber and the vertical length of the discharge conduit from the chamber, the arrangement disclosed by the Umino patent is very limited in available operating pressures and there is no means provided to prevent backflow of molten metal into the furnace from the chamber. The flow of molten metal out of the furnace cannot be accurately controlled and the pressure is extremely limited and difficult to control.

U.S. Pat. No. 5,913,358 to Chadwick discloses a casting apparatus that includes a holding furnace for holding a reservoir of molten metal and a smaller pumping furnace in fluid communication with the holding furnace through a non-return, ball check valve. The pumping furnace is integrally formed with the holding furnace. The ball check valve prevents the flow of molten metal from the pumping furnace to the holding furnace during pressurization of the pumping furnace, but allows the flow of molten metal from the holding furnace to the pumping furnace after pressurization.

The holding furnace/pumping furnace arrangement disclosed by the Chadwick patent has several drawbacks. First, the ball check valve providing the connection between the holding furnace and the pumping furnace is a passive device that provides little ability to control the inflow of molten metal to the pumping furnace. In addition, the use of ball check valves in such molten metal transfer arrangements is known to have practical disadvantages. In particular, ball check valves require clean molten metal flows to operate effectively. The introduction of metal oxide particulates in the molten metal flows will cause the roller ball of the ball check valve to stick or prevent its full closing position from being obtained and this will require that the furnace be drained and the ball check valve cleaned. Further, the integrally formed holding furnace/pumping furnace arrangement disclosed by the Chadwick patent provides little flexibility in dosing molten metal to downstream processes such as a die casting machine. The position of the pumping furnace is fixed with respect to the holding furnace, which limits the locations from which molten metal may be dosed from the holding furnace/pumping furnace arrangement.

SUMMARY OF THE INVENTION

In view of the foregoing, it is an object of the present invention to provide a casting arrangement that includes a gas driven molten metal injector that provides the ability to control the inflow and filling of molten metal into the injector. In addition, it is an object of the present invention to provide a casting apparatus that includes a plurality of gas driven molten metal injectors that may be independently positioned and operated in a molten metal holding vessel. It is a further object of the present invention to provide a gas driven molten metal injector that improves metal quality delivery to downstream processes. This invention provides for accurate control of injected molten metal flow rate and subsequent holding pressure applied to metal held in a mold cavity of a die casting machine.

The above objects are accomplished with a casting apparatus made in accordance with the present invention. The casting apparatus includes a holding vessel for containing a supply of molten metal. A casting mold is located above the holding vessel and defines a casting cavity. A molten metal injector extends into the holding vessel and is at least partially immersed in molten metal when the holding vessel contains the supply of molten metal. The molten metal injector includes an injector body that defines an inlet opening for receiving molten metal into the injector body from the supply of molten metal contained in the holding vessel. A gas pressurization source is in fluid communication with the injector body for cyclically pressurizing the injector body and inducing molten metal to flow from the injector to the casting cavity of the casting mold, and for exhausting to atmospheric pressure to permit filling of the injector body with molten metal. An inlet valve is located in the inlet opening in the injector body for filling molten metal into the injector body. The inlet valve is configured to prevent outflow of molten metal from the injector body during pressurization of the injector body and permit inflow of molten metal (i.e., filling/refilling) into the injector body after pressurization. The inlet valve has an inlet valve actuator located above the surface of the supply of molten metal and is operatively connected to the inlet valve for operating the inlet valve between an open position allowing for the filling of the injector body with molten metal and a closed position allowing for the pressurization of the injector body. The gas pressurization source may be operable to pressurize the injector body when the inlet valve is in the closed position and to exhaust to atmospheric pressure when the inlet valve is open.

The injector body may be defined by a top wall, sidewalls, and a bottom wall. The gas pressurization source may be in fluid communication with the injector body through the top wall of the injector body. The inlet opening may be provided as an inlet conduit extending from one of the sidewalls of the injector body. The inlet valve may be located in the inlet conduit.

The injector body may include a fill tube extending into the injector body and in fluid communication with the casting cavity. The fill tube may be integrally formed with the injector body. A molten metal filter may cover the inlet opening for filtering the molten metal entering the injector body through the inlet opening. The fill tube may define an opening within the injector body. A second molten metal filter may cover the opening to the fill tube. The injector body and the inlet valve may be made of graphite, ceramic material, or a mixture of graphite and ceramic material.

The present invention is also directed to a gas driven molten metal injector for use with a holding vessel containing a supply of molten metal. The molten metal injector includes an injector body defining an inlet opening for receiving molten metal into the injector body from the supply of molten metal when the injector body is at least partially immersed in the supply of molten metal. A fill tube extends into the injector body for dosing molten metal from the injector body to a downstream process. A gas pressurization source is in fluid communication with the injector body for cyclically pressurizing the injector body and inducing molten metal to flow into the fill tube, and for exhausting to atmospheric pressure to permit filling of the injector body with molten metal. An inlet valve is located in the inlet opening in the injector body for filling molten metal into the injector body. The inlet valve is configured to prevent outflow of molten metal from the injector body during pressurization of the injector body and permit inflow of molten metal into the injector body after pressurization. An inlet valve actuator is operatively connected to the inlet valve for operating the inlet valve between an open position allowing for the filling of the injector body with molten metal and a closed position allowing for the pressurization of the injector body. The gas pressurization source may be operable to pressurize the injector body when the inlet valve is in the closed position and to exhaust to atmospheric pressure when the inlet valve is open.

Furthermore, the present invention is a method of casting a metal component that may include the steps of: providing a holding vessel containing a supply of molten metal; locating a casting mold above the holding vessel with the casting mold having a casting cavity; positioning a molten metal injector in the holding vessel such that the molten metal injector is at least partially immersed in the supply of molten metal, with the molten metal injector in fluid communication with the casting cavity of the casting mold, with the molten metal injector having an injector body defining an inlet opening for receiving molten metal into the injector body from the supply of molten metal contained in the holding vessel, and with the molten metal injector having an inlet valve located in the inlet opening in the injector body and having an inlet valve actuator connected to the inlet valve for operating the inlet valve between an open position and a closed position; placing a gas pressurization source in fluid communication with the injector body for cyclically pressurizing the injector body and inducing molten metal to flow from the molten metal injector to the casting cavity of the casting mold and for exhausting to atmospheric pressure to permit filling of the injector body with molten metal; operating the inlet valve to the open position to allow filling (i.e., refilling) of molten metal into the injector body through the inlet opening; operating the inlet valve to the closed position after the injector body is at least partially filled with molten metal; and pressurizing the injector body with the gas pressurization source to induce molten metal to flow from the injector body to the casting cavity of the casting mold.

The method according to the present invention may include the steps of filtering the molten metal entering the injector body through the inlet opening and filtering the molten metal within the injector body before passing the molten metal to the casting cavity of the casting mold. The inlet valve actuator may be located above the surface of the supply of molten metal contained in the holding vessel, and the method may further include the step of operating the inlet valve between the open and closed positions from above the surface of the molten metal with the inlet valve actuator. The injector body may be provided with an integrally formed and vertically extending fill tube in fluid communication with the casting cavity of the casting mold. Further, the method according to the present invention may include the step of depressurizing the injector body after a set duration of time to allow the molten metal received in the casting cavity of the casting mold to substantially solidify.

The method may also include the steps of positioning a plurality of the molten metal injectors in the holding vessel such that each of the molten metal injectors is at least partially immersed in the supply of molten metal and independently operating the inlet valve and gas pressurization source for each of the molten metal injectors. The step of independently operating the inlet valve and gas pressurization source for each of the molten metal injectors may be performed by a programmable logic controller or a programmable computer. The inlet valve and gas pressurization source for each of the molten metal injectors may be operated such that each of the plurality of molten metal injectors doses molten metal to the casting cavity of the casting mold at different times and at different rates. The injector body for each of the molten metal injectors may be depressurized substantially simultaneously after a set duration of time has elapsed to allow the molten metal in the casting cavity to substantially solidify. The inlet valve and gas pressurization source for each of the molten metal injectors may be further operated such that at least two of the plurality of molten metal injectors dose molten metal to the casting cavity of the casting mold at substantially the same time and at substantially the same rate.

Further details and advantages of the present invention will become apparent from the following detailed description read in connection with the drawings.

DETAILED DESCRIPTION OF THE PREFERRED EMBODIMENTS

Figure 1:
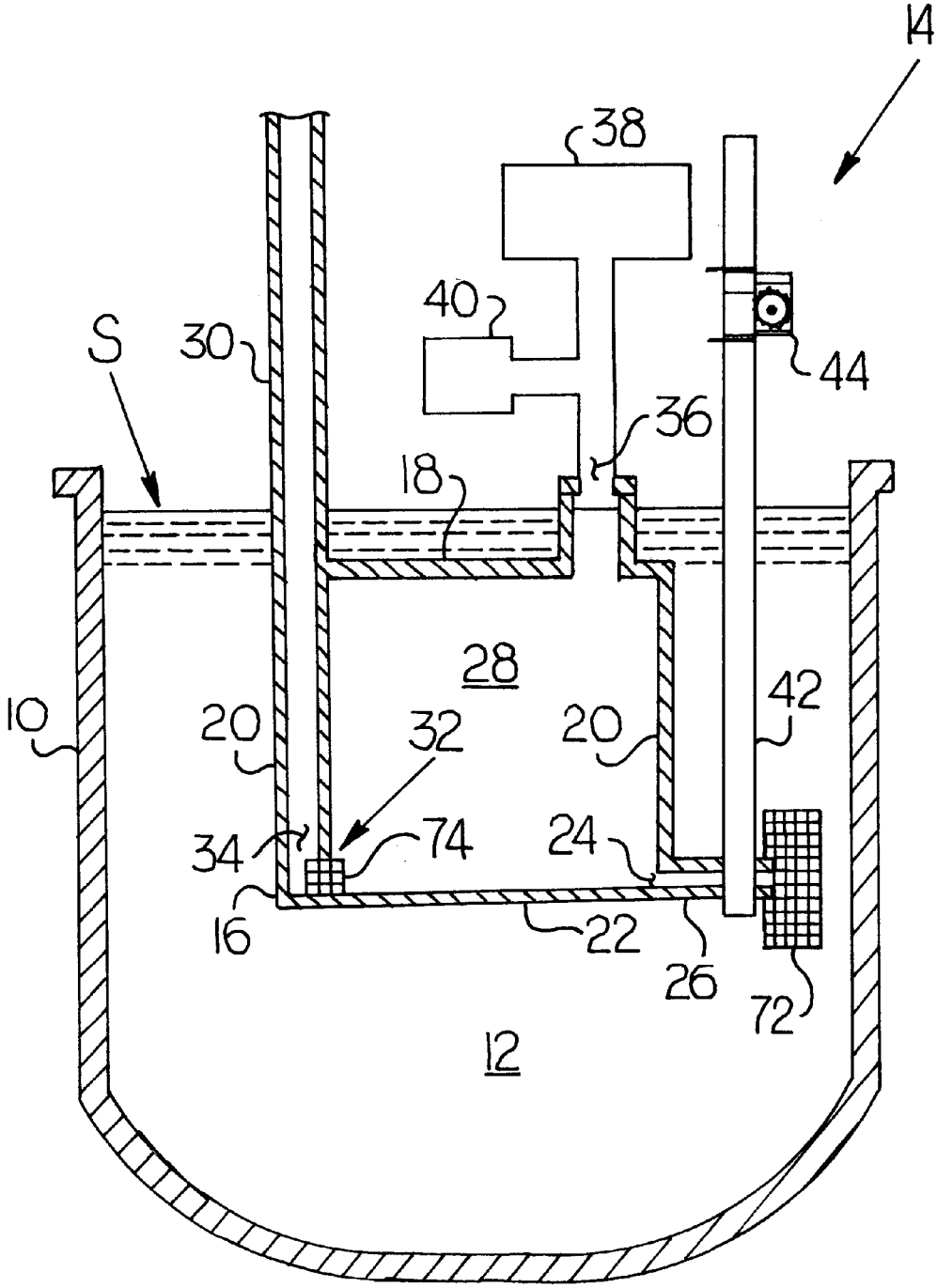
FIG. 1 is a schematic cross-sectional side view of a gas driven molten metal injector in accordance with the present invention and submerged in a molten metal holding vessel.

FIG. 1 shows a holding vessel 10 containing a supply of molten metal 12 and a molten metal injector 14 made in accordance with the present invention and extending into the holding vessel 10. The holding vessel 10 may be of any suitable design and may, for example, be a holding furnace, melting furnace, or simply a furnace ladle. The holding vessel 10 is preferably a refractory-lined steel pressure vessel that is adequate to contain metals and metal alloys having a low melting point, such as aluminum alloy, magnesium, brass, bronze, zinc, copper, and the like. The holding vessel 10 may be heated by any conventional method known in the art. The surface of the molten metal 12 contained in the holding vessel 10 is designated with reference character "S". The molten metal injector generally designated with reference numeral 14 extends into the holding vessel 10 and is at least partially immersed in the molten metal 12 contained in the holding vessel 10. The molten metal injector 14 is preferably suitable for use with metals and metal alloys having a low melting point, such as aluminum alloy, magnesium, brass, bronze, zinc, copper, and the like.

The molten metal injector 14 is preferably at least partially submerged in the molten metal 12 contained in the holding vessel 10. The molten metal injector 14 includes an injector body 16 that may take any suitable shape, such as spherical, rectangular, or polygonal. In the embodiment of the molten metal injector 14 shown in the figures, the injector body 16 is generally defined by a top wall 18, a plurality of sidewalls 20, and a bottom wall 22. An inlet opening 24 to the injector body 16 is defined by an inlet conduit 26 extending from one of the sidewalls 20 of the injector body 16. The inlet opening 24 may also be located in the top wall 18 or the bottom wall 22 of the injector body 16. The inlet conduit 26 and inlet opening 24 allow the molten metal 12 contained in the holding vessel 10 to flow into and fill an injector cavity 28 of the injector body 16. The injector body 16 is preferably made of graphite, ceramic material, or a combination or mixture of graphite and ceramic material. Each of the foregoing materials is selected for their suitability for use with molten aluminum alloy and the like.

The injector body 16 further includes a fill or discharge tube 30 for dosing the molten metal 12 contained in the injector cavity 28 of the injector body 16 to a downstream process, such as a die casting machine as discussed further hereinafter. The fill tube 30 is preferably formed integrally with the injector body 16 and extends vertically upward to cooperate with the intended downstream process. The fill tube 30 at a lower end 32 defines an opening 34 that opens to the injector cavity 28 of the injector body 16. Accordingly, the fill tube opening 34 defines the molten metal outlet for the injector body 16. The opening 34 to the fill tube 30 may also extend from the bottom wall 22 of the injector body 16 up to a point near the top wall 18 of the injector body 16 and is not intended to be limited to the opening size shown in FIG. 1. In addition, the fill tube 30 may take other configurations including having the fill tube 30 exit through the bottom wall 22 of the injector body 16 and proceed upward to a designated downstream process. Further, the fill tube 30 may be formed on the outside of one of the sidewalls 20 of the injector body 16 and extend upward substantially as shown in FIG. 1.

The injector body 16 further includes a gas inlet opening 36 defined in the top wall 18 of the injector body 16. The gas inlet opening 36 is connected to a gas pressurization source 38, which is used to cyclically pressurize the injector body 16 and induce the molten metal 12 received in the injector cavity 28 of the injector body 16 to flow up the fill tube 30 to the designated downstream process. The gas pressurization source 38 may be used to supply an inert gas, such as argon or nitrogen, or compressed air to the injector cavity 28 of the injector body 16. The injector body 16 is preferably constructed to withstand operating pressures of between about 5 to 15 psi. The present invention also envisions that the injector body 16 may be constructed to withstand operating pressures up to about 100 psi. The gas pressurization source 38 may further include a pressure controller 40, which is used to control the pressure of the gas supply to the injector cavity 28 of the injector body 16.

The molten metal injector 14 preferably further includes an inlet valve 42 that is operable to open and close the inlet opening 24 and the inlet conduit 26 connected to the injector cavity 28 of the injector body 16. The inlet valve 42 may also be located in the top wall 18 or bottom wall 22 when the inlet opening 24 is located in one of these walls of the injector body 16. Preferably, as shown in FIG. 1, the inlet valve 42 is a simple on/off valve that is actuated by an inlet valve actuator 44 located above the surface S of the molten metal 12 contained in the holding vessel 10. The inlet valve 42 will permit the flow of the molten metal 12 into the injector body 16 through the inlet conduit 26 for filling/refilling of the injector cavity 28 of the injector body 16.

Generally, the inlet valve 42 will be in an open position and allow inflow of the molten metal 12 into the injector body 16 when the injector body 16 is not pressurized by the gas pressurization source 38. Similarly, the inlet valve 42 will be in the closed position during periods when the gas pressurization source 38 pressurizes the injector body 16, which induces the molten metal 12 contained in the injector body 16 to flow upward into the fill tube 30 and ultimately to a downstream process, such as a die casting apparatus. As discussed further herein, the gas pressurization source 38 and the inlet valve actuator 44 may be automatically controlled by a control device, such as a programmable computer (PC) or programmable logic controller (PLC), which will automate the injection cycle of the molten metal injector 14. The inlet valve 42 and the inlet valve actuator 44 may be replaced by similar devices for regulating the flow of molten metal into the injector body 16. For example, the inlet valve 42 and the inlet valve actuator 44 may be replaced by a simple check valve (not shown) that operates to allow inflow of the molten metal 12 during periods when the injector body 16 is not pressurized, and to prevent outflow of the molten metal during periods when the gas pressurization source 38 pressurizes the injector body 16. The check valve may be a ball check valve, which includes a ball that may slide between a seat and a stop that limits the movement of the ball. The Chadwick patent discussed previously, and incorporated herein by reference, discloses such a device.

Figure 2:
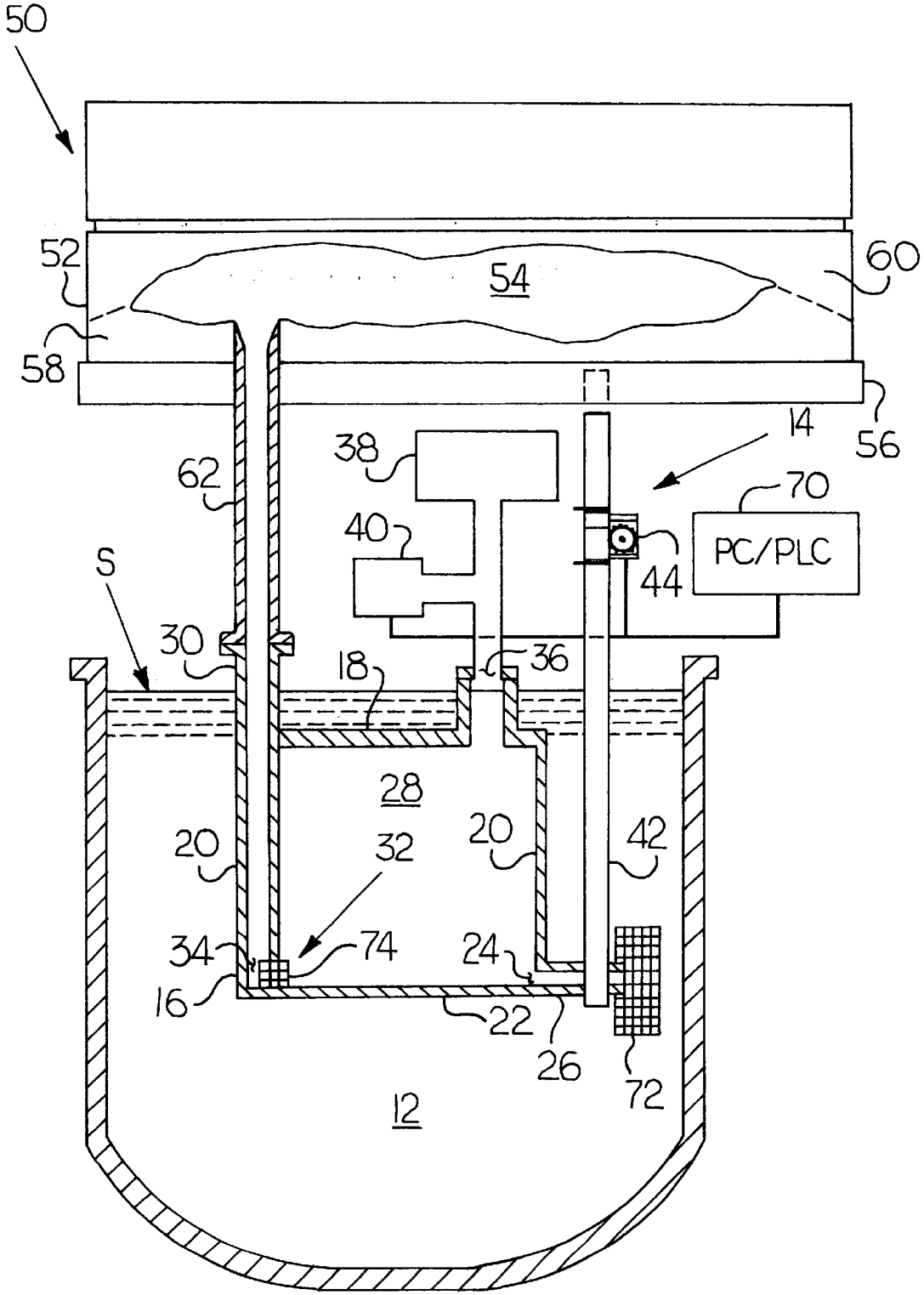
FIG. 2 is a schematic cross-sectional view of a casting apparatus in accordance with the present invention and including the gas driven molten metal injector shown in FIG. 1.

Referring to FIG. 2, the present invention envisions that the molten metal injector 14 may be incorporated as part of a casting apparatus 50 for casting a metal component or part. The casting apparatus 50 shown in FIG. 2 includes a casting mold 52 that defines a casting cavity or mold cavity 54 for casting a metal part, such as an automobile part. The casting mold 52 and the casting cavity 54 may be configured to cast ultra-large, thin-walled components that may be used in a ground transportation vehicle, such as an automobile. An ultra-large, thin-walled component part for a ground transportation vehicle may have dimensions as large as, for example, 3.0 meters long, 1.7 meters wide, and 0.4 meters in depth as examples. The casting cavity 54 is preferably configured for use with molten metal having a low melting point, such as the metals identified previously. The casting mold 52 includes a holder frame 56 for supporting the casting mold 52. The casting mold 52 is generally defined by a lower die cavity 58 and an upper die cavity 60, which together define the casting cavity 54. The casting mold 52 through the holder frame 56 is supported by a support surface (not shown) according to means customary in the art. The casting mold 52 is preferably located about 1–3 feet above the holding vessel 10.

As shown in FIG. 2, the holding vessel 10 and molten metal injector 14 are located below the casting mold 52. Accordingly, the molten metal injector 14 injects or doses the molten metal 12 upward against the force of gravity into the casting cavity 54. The molten metal injector 14 is particularly well-suited for producing components from lightweight, non-ferrous materials, such as aluminum, aluminum alloys, brass, bronze, magnesium, zinc, and copper. The molten metal injector 14 in accordance with the present invention preferably operates at pressures on the order of about 5 to 15 psi.

The molten metal injector 14 shown in FIG. 2 is identical to the molten metal injector 14 of FIG. 1, with the addition that the fill tube 30 is connected to a fill conduit 62 in fluid communication with the casting cavity 54. The fill tube 30 and fill conduit 62 may be connected by any means customary in the art, such as the flanged and gasketed connection schematically shown in FIG. 2. The fill tube 30 and fill conduit 62 generally place the injector cavity 28 of the injector body 16 in fluid communication with the casting cavity 54 of the casting mold 52. The fill tube 30 and fill conduit 62 may be integrally formed as part of the injector body 16.

With continued reference to FIG. 2, operation of the molten metal injector 14 as part of the casting apparatus 50 will now be discussed. The holding vessel 10 includes the supply of molten metal 12 and the casting mold 52 is fixed above the holding vessel 10. The molten metal injector 14 is preferably placed in the holding vessel 10 such that the molten metal injector 14 is at least partially submerged in the supply of molten metal 12. The molten metal injector 14 through the fill tube 30 and fill conduit 62 is in fluid communication with the casting cavity 54 of the casting mold 52. The inlet valve 42 may be operated by the inlet valve actuator 44 to the open position, which allows the molten metal 12 contained in the holding vessel 10 to flow into the injector cavity 28 of the injector body 16. With the inlet valve 42 in the open position, the gas pressurization source 38 does not provide pressurization gas to the injector body 16. With the inlet valve 42 in the open position, the molten metal 12 flows into the injector cavity 28 of the injector body 16 under the hydrostatic pressure of the molten metal 12 contained in the holding vessel 10.

After a set duration of time, the injector body 16 is substantially filled and the inlet valve 42 is moved to the closed position, which stops further flow of molten metal to the injector cavity 28. The injector body 16 is at this point at least partially filled with the molten metal 12. With the inlet valve 42 in the closed position, a controlled pressurization gas is then supplied to the injector body 16 from the gas pressurization source 38. The pressurization gas enters the injector body 16 through the gas inlet opening 36 in the top wall 18 of the injector body 16. The molten metal level in the injector body 16 is lowered and the molten metal 12 flows upward through the opening 34 and into the fill tube 30 and the fill conduit 62. As pressurization gas continues to flow into the injector body 16, the molten metal 12 continues to flow upward in the fill tube 30 and the fill conduit 62, and then enters the casting cavity 54 of the casting mold 52.

As shown in FIG. 2, a control device 70, such as a PC or PLC, may be used to control both the gas pressurization source 38 and the inlet valve actuator 44 to automate the injection cycle of the molten metal injector 14. Thus, the control device 70 may send a signal to the inlet valve actuator 44 to open the inlet valve 42 to allow inflow (i.e., filling) of the molten metal 12 into the injector body 16 while simultaneously sending a signal to the gas pressurization source 38 and, more particularly, the pressure controller 40, to prevent the gas pressurization source 38 from pressurizing the injector body 16. In most practical situations, the inlet valve 42 will be open for a sufficient time period to permit the level of molten metal in the injector cavity 28 of the injector body 16 to approximate the level of molten metal 12 in the holding vessel 10. The control device 70 may be programmed to limit the length of time the inlet valve 42 is in the open position and, thereby, control the amount of the molten metal 12 received into the injector body 16. The control device 70 may be used to operate the inlet valve 42 to the closed position and then turn on the gas pressurization source 38 via the pressure controller 40 to pressurize the injector cavity 28 of the injector body 16. The control device 70 may further be used to control the rate of gas pressurization of the injector cavity 28 of the injector body 16 via the pressure controller 40. In effect, the length of time and the quantity of molten metal 12 flowing into the casting cavity 54 may be totally and accurately controlled. Further, once the casting cavity 54 is completely filled with the molten metal 12, the injector body 16 may be maintained in a pressurized state to apply continued pressure to the molten metal 12 now received in the casting cavity 54, which will help prevent the formation of air pockets and voids within the resulting cast metal component and permit sufficient time for the molten metal to substantially solidify within the casting cavity 54.

After the time for molten metal solidification has passed, the gas pressurization source 38 via the pressure controller 40 is turned off and gas pressure returns to atmospheric levels. The molten metal 12 now located in the casting cavity 54 is preferably given a sufficient amount of time to completely solidify before the injector body 16 is depressurized. The inlet valve 42 may then be moved to the open position by the inlet valve actuator 44 to allow for inflow (i.e., refilling) of the molten metal 12 in the injector body 16 and repetition of the foregoing described molten metal injection cycle. As shown in FIGS. 1 and 2, the inlet opening 24 and inlet conduit 26 to the injector body 16 may be covered by a molten metal filter 72, which will filter the molten metal 12 before it passes to the injector cavity 28 of the injector body 16. Further, a second molten metal filter 74 may be located in the opening 34 of the fill tube 30 to provide a second stage of filtering for the molten metal 12 before it is passed to the casting cavity 54 of the casting mold 52.

Figure 3:
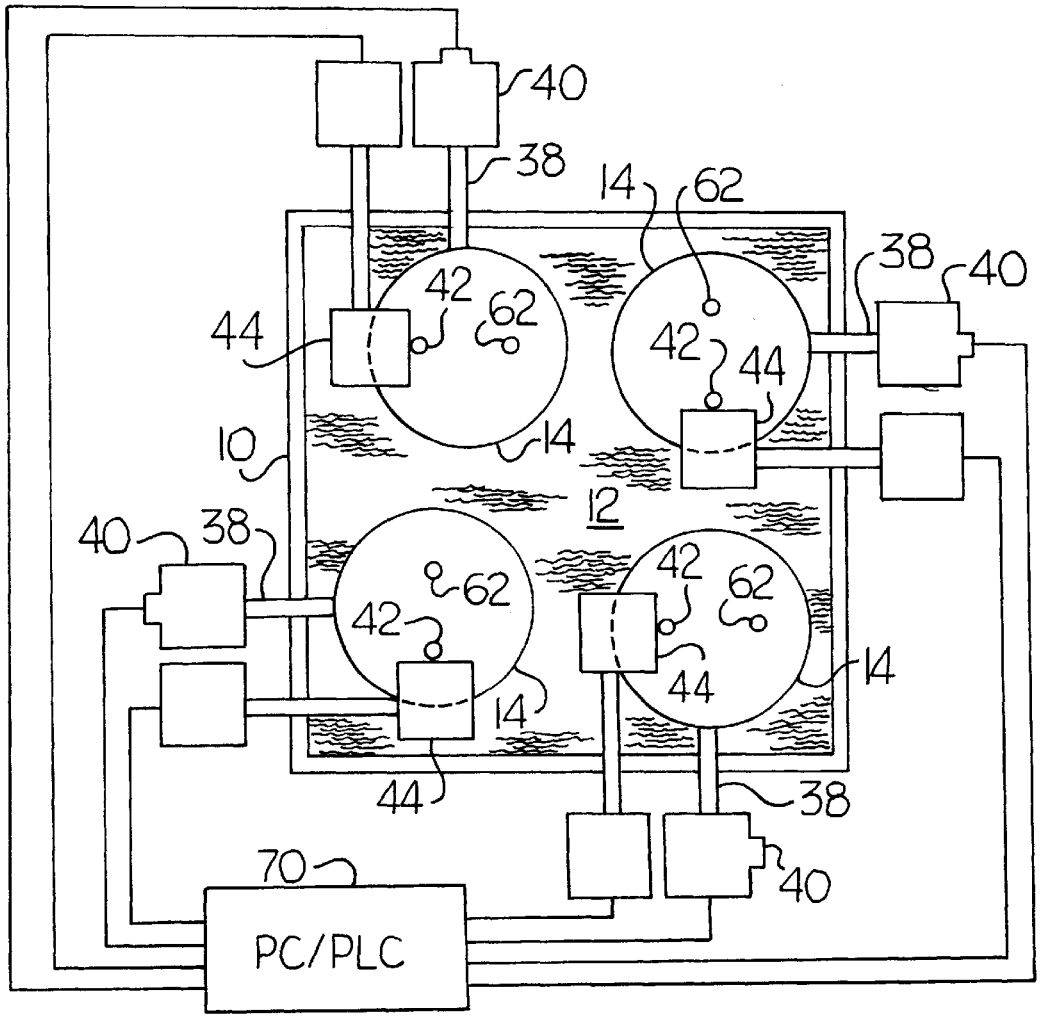
FIG. 3 is a schematic plan view of a casting apparatus in accordance with the present invention and including a plurality of the gas driven molten metal injectors shown in FIG. 1.

FIG. 3 shows in plan view a possible arrangement of the molten metal injectors 14 for injecting the molten metal 12 into multiple locations of the casting cavity 54 of the casting mold 52 shown in FIG. 2. The molten metal injectors 14 extend downward into the holding vessel 10 and are each partially submerged in the molten metal 12 contained therein, as described previously. The inlet valve actuators 44 are each separately connected to and independently controlled by the control device 70. The control device 70 also controls the gas pressurization source 38 via the pressure controller 40 for each of the molten metal injectors 14 independently. Thus, the control device 70 may independently operate the injection cycle of each of the molten metal injectors 14. Accordingly, the molten metal injectors 14 may be independently and selectively operated to inject the molten metal 12 into the casting cavity 54 at different times and different rates as dictated by the configuration of the casting cavity 54 to form a one-piece cast metal part of improved quality. The schematic representation of FIG. 3 shows that each individual molten metal injector 14 pressure-time dependence and inlet valve 42 on/off cycles may be programmed independently from each other. The individual molten metal injectors 14 will each follow the overall injection cycle process discussed hereinabove.

The casting apparatus 50 and gas driven molten metal injector 14 described hereinabove provides the ability to control the inflow of the molten metal 12 into the casting cavity 54 of the casting mold 52 at multiple locations. In addition, the casting apparatus 50 and the molten metal injector 14 described hereinabove provide for the counter-gravity injection of the molten metal 12 into the casting mold 52. The counter-gravity injection of the molten metal 12 decreases the possibility of air pockets and voids forming within the resulting cast metal component or part thus increasing the quality of the resulting cast metal component. Further, the casting apparatus 50 and the molten metal injector 14 described hereinabove advantageously locate the inlet valve actuator 44 above the surface S of the molten metal 12 and away from the caustic effects of the molten metal 12, particularly when the molten metal 12 is an aluminum-based alloy. Furthermore, the inlet opening 24 to the injector body 16 according to the present invention is located in the sidewall 20 of the injector body 16 and is spaced away from the surface S of the molten metal 12, which minimizes the possible formation and introduction of metal oxide solids into the injector cavity 28 of the injector body 16 and improves overall metal quality delivery to the casting mold 52. Finally, the molten metal injectors 14 provided with the casting apparatus 50 described hereinabove may be individually controlled and operated to selectively introduce the molten metal 12 into the casting cavity 54 of the casting mold 52.

While the preferred embodiments of the present invention were described herein, various modifications and alterations of the present invention may be made without departing from the spirit and scope of the present invention. The scope of the present invention is defined by the appended claims and any equivalents thereto.

I claim:

1. A method of casting a metal component, comprising the steps of:

providing a holding vessel containing a supply of molten metal;

locating a casting mold above the holding vessel, with the casting mold having a casting cavity;

positioning a molten metal injector in the holding vessel such that the molten metal injector is at least partially immersed in the supply of molten metal, with the molten metal injector in fluid communication with the casting cavity of the casting mold, with the molten metal injector having an injector body including a top wall, sidewalls, and a bottom wall, with an inlet conduit extending outward from one of the sidewalls and defining an inlet opening for receiving molten metal into the injector body from the supply of molten metal, and with the molten metal injector having an inlet valve located in the inlet opening in the injector body and having an inlet valve actuator located above the supply of molten metal and connected to the inlet valve for operating the inlet valve between an open position and a closed position;

placing a gas pressurization source in fluid communication with the injector body for cyclically pressurizing the injector body and inducing molten metal to flow from the molten metal injector to the casting cavity of the casting mold and for exhausting to atmospheric pressure to permit filling of the injector body with molten metal;

operating the inlet valve to the open position from above the supply of molten metal to allow filling of molten metal into the injector body through the sidewall of the injector body;

operating the inlet valve to the closed position from above the supply of molten metal after the injector body is at least partially filled with molten metal; and pressurizing the injector body with the gas pressurization source to induce molten metal to flow from the injector body to the casting cavity of the casting mold.

2. The method of claim 1, further comprising the step of filtering the molten metal entering the injector body through the inlet opening.

3. The method of claim 2, further comprising the step of filtering the molten metal within the injector body before passing the molten metal to the casting cavity of the casting mold.

4. The method of claim 1, further comprising the step of providing the injector body with an integrally formed and vertically extending fill tube in fluid communication with the casting cavity of the casting mold.

5. The method of claim 1, further comprising the step of depressurizing the injector body after a set duration of time to allow the molten metal received in the casting cavity of the casting mold to substantially solidify.

6. The method of claim 1, further comprising the steps of positioning a plurality of the molten metal injectors in the holding vessel such that each of the molten metal injectors is at least partially immersed in the supply of molten metal and independently operating the inlet valve and gas pressurization source for each of the molten metal injectors.

7. The method of claim 6, wherein the step of independently operating the inlet valve and gas pressurization source for each of the molten metal injectors is performed by one of a programmable logic controller and a programmable computer.

8. The method of claim 6, wherein the step of independently operating the inlet valve and gas pressurization source for each of the molten metal injectors is performed such that each of the plurality of molten metal injectors doses molten metal to the casting cavity of the casting mold at different times and at different rates.

9. The method of claim 8, further comprising the step of substantially simultaneously depressurizing the injector body of each of the molten metal injectors after a set duration of time to allow the molten metal received in the casting cavity of the casting mold to substantially solidify.

10. The method of claim 6, wherein the step of independently operating the inlet valve and gas pressurization source for each of the molten metal injectors is performed such that at least two of the plurality of molten metal injectors doses molten metal to the casting cavity of the casting mold at substantially the same time and at substantially the same rate.

* * * * *